US007403737B2

(12) United States Patent
Coleman et al.

(10) Patent No.: US 7,403,737 B2
(45) Date of Patent: Jul. 22, 2008

(54) METHOD OF PREVENTING MEDIA WRINKLING

(75) Inventors: Larry Christopher Coleman, Lexington, KY (US); Russell Edward Lucas, Lexington, KY (US); Jason Kyle Romain, Versailles, KY (US); Larry Earl Stahlman, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 103 days.

(21) Appl. No.: 11/017,977

(22) Filed: Dec. 21, 2004

(65) Prior Publication Data

US 2006/0133867 A1 Jun. 22, 2006

(51) Int. Cl.
*G03G 15/20* (2006.01)

(52) U.S. Cl. ..... 399/322

(58) Field of Classification Search ..... 399/322, 399/329, 68, 320; 219/216
See application file for complete search history.

(56) References Cited

U.S. PATENT DOCUMENTS

| | | | | |
|---|---|---|---|---|
| 5,202,737 | A | 4/1993 | Hollar | |
| 5,268,729 | A | 12/1993 | Kunishige | |
| 5,355,204 | A * | 10/1994 | Aoki | 399/329 |
| 5,392,106 | A | 2/1995 | Bigenwald et al. | |
| 5,414,503 | A | 5/1995 | Siegel et al. | |
| 5,515,152 | A | 5/1996 | Kuo | |
| 5,519,481 | A | 5/1996 | Kuo | |
| 5,565,971 | A | 10/1996 | Kuo et al. | |
| 5,848,347 | A | 12/1998 | Kuo et al. | |
| 5,937,258 | A | 8/1999 | Acquaviva et al. | |
| 6,160,982 | A | 12/2000 | Chow | |
| 6,246,860 | B1 | 6/2001 | Ohmichi | |
| 6,266,510 | B1 * | 7/2001 | Curry et al. | 399/329 |
| 6,272,310 | B1 | 8/2001 | Blair et al. | |
| 6,668,155 | B1 | 12/2003 | Hubble, III et al. | |
| 6,697,589 | B1 | 2/2004 | Dunning et al. | |
| 6,775,509 | B2 * | 8/2004 | Shida et al. | 399/328 |
| 6,801,745 | B1 | 10/2004 | Gogate et al. | |
| 6,808,259 | B2 | 10/2004 | Rasmussen et al. | |
| 6,810,229 | B2 | 10/2004 | Coleman et al. | |
| 6,816,692 | B1 | 11/2004 | Kerley et al. | |
| 6,818,290 | B1 | 11/2004 | Chopra et al. | |
| 6,961,532 | B2 * | 11/2005 | Uekawa et al. | 399/329 |
| 2003/0077092 | A1 * | 4/2003 | Ogawa et al. | 399/328 |
| 2003/0170054 | A1 * | 9/2003 | Suzuki et al. | 399/328 |
| 2006/0067754 | A1 * | 3/2006 | Gilmore et al. | 399/333 |
| 2007/0065191 | A1 * | 3/2007 | Iwasaki et al. | 399/328 |

FOREIGN PATENT DOCUMENTS

JP 03233586 A * 10/1991

(Continued)

*Primary Examiner*—Quana M Grainger
(74) *Attorney, Agent, or Firm*—Grossman, Tucker, Perreaul & Pfleger, PLLC

(57) ABSTRACT

An apparatus and method are provided for the reduction of wrinkles formed in sheets of paper media which may contain various levels of absorbed moisture across the surface and which are processed through a fuser section of a printing or copying device. Protruding features may be provided laterally spaced apart by a desired paper width at the fuser nip to create a pressure contact area which constrains the outer longitudinal edges of the sheet of paper as it enters the nip.

23 Claims, 3 Drawing Sheets

FOREIGN PATENT DOCUMENTS

| | | | | |
|---|---|---|---|---|
| JP | 10247026 | A | * | 9/1998 |
| JP | 10340017 | A | * | 12/1998 |
| JP | 11073046 | A | * | 3/1999 |
| JP | 11212384 | A | * | 8/1999 |
| JP | 2000321893 | A | * | 11/2000 |

* cited by examiner

METHOD OF PREVENTING MEDIA WRINKLING

FIELD OF INVENTION

The present invention relates to an apparatus and method for reduction in the wrinkling of paper media processed through a fuser in an electrophotographic device. More particularly, the present invention provides an apparatus and method for reducing the amount of wrinkling in paper media which, due to, e.g., exposure to various levels of humidity, may have wavy edges which may form into wrinkles when processed through a fuser nip.

BACKGROUND OF THE INVENTION

Image forming apparatus and devices such as a copying machine, a printer or a facsimile machine may use an electrophotographic system to heat and fuse a developer image that has been transferred from an image bearing body to a sheet of media, such as paper or a transparency resin sheet, and "fix" the image to a surface of the sheet. The transferring body may comprise nip rolls or a belt assembly. These devices preferably operate at high speeds to produce multiple copies rapidly. In doing so, a significant amount of heat energy is transferred to the sheet media as the fuser for the toner being transferred may operate in the range of about 130° C. to about 220° C. depending on the media transit speed and the nature of toner transferred. Processing of sheets of paper through the fuser nip compresses and flattens the sheet just before the image is being fixed onto the surface of the sheet.

Paper media is usually packaged in reams of 500 sheets enclosed in a protective, often waterproof wrapper. Since the paper is somewhat hydroscopic, it may absorb humidity when exposed to ambient air. Depending on storage conditions for the paper sheets, once the protective packaging has been opened the paper may absorb moisture from the surrounding air causing the fibers of the paper to swell and lengthen. This may result in a change in the dimensions of the sheets of paper depending on whether the moisture is absorbed uniformly or non-uniformly across the length and width of the sheet. Such moisture absorption may lead to wavy edges being formed.

On processing these wavy sheets of paper through the electrophotographic fusing process, the paper is drawn through a nip between rollers or between a roller and a belt, and the wavy edges may fold or wrinkle causing defective copies and customer complaints. In humid environments, these defects may occur in more than 50% of the copies being made.

There is some art addressing paper curling as caused by heating during the fusing process. For example, U.S. Pat. No. 6,266,510, entitled "Control of Wrinkling In Belt Fuser By Nip Configuration", is commonly assigned to the assignee of the present invention and included herein by reference in its entirety.

SUMMARY OF THE INVENTION

The present invention is directed at an apparatus and a method for reduction in the wrinkling of sheets of paper processed through the nip of a fuser mechanism by substantially constraining the width of the leading edge of the sheet of paper to a desired width.

In a first embodiment, the present invention comprises an apparatus for fixing an image on a sheet of recording media, comprising a heater mounted in a heater housing, the housing having laterally spaced apart ends. A belt is provided that is slideable on the heater, along with a driven roller, the heater cooperating with the driven roller, with the belt being interposed between the driven roller and the heater to form a nip.

The heater housing includes features at each end, such features available to constrain a sheet of supplied media as the media enters said nip.

In a second alternative embodiment the present invention relates to a method for reducing wrinkling of a sheet of print media in an electrophotographic device, comprising the steps of providing a heater mounted in a heater housing, the housing having laterally spaced apart ends and providing a belt slideable on the heater. This is followed by providing a driven roller, the heater cooperating with the driven roller, with the belt being interposed between said driven roller and said heater to form a nip. The sheet of media is transported through the nip by the roller and an image carried on the sheet of recording media is heated through the belt while in the nip by heat from the heater. The heater housing includes features at each end, the features available to constrain a sheet of supplied media as the media enters the nip.

In a third alternative embodiment, the present invention relates to an apparatus for reducing wrinkling of a sheet of media in a fuser in an electrophotographic device, the sheet having a leading edge with leading corners and longitudinal sides, the apparatus comprising a heater mounted in a heater housing, the housing having laterally spaced apart ends wherein the heater housing includes features at each end. A belt is provided that is slideable on the heater along with a driven roller, the heater cooperating with the driven roller and the belt being interposed between the driven roller and the heater to form a nip wherein the sheet of media is transported through the nip by the roller. The apparatus includes laterally spaced apart features at the ends of the heater housing and a portion of the features are spaced apart by a distance that is less than the width of the sheet of media, the features available to constrain the media as the media enters said nip.

In a fourth alternative embodiment, the present invention relates to an apparatus for fixing an image on a sheet of recording media, comprising a first fuser roller including a heater wherein said roller is mounted into a fuser frame. The apparatus includes a second roller, the fuser roller cooperating with the second roller to form a nip, wherein an image carried on the sheet of recording media is heated by the fuser roller while in the nip by heat from fuser roller. The fuser frame includes protruding features, where such features are available to constrain a sheet of supplied media as said media enters said nip to substantially reduce media wrinkling.

DETAILED DESCRIPTION OF THE PREFERRED EMBODIMENT

Printing or copying an image onto a sheet of media or paper substrate is typically accomplished by fixing a loose powder toner using heat onto the surface of the media in an electrophotographic process.

In electrophotography, a latent image is created on the surface of an insulating, photoconducting material by selectively exposing an area of the surface to light. A difference in electrostatic density is created between the areas on the surface exposed and those not exposed to the light. The latent electrostatic image is developed into a visible image by electrostatic toners which contain pigment components and thermoplastic components. The toners, which may be liquids or powders, are selectively attracted to the photoconductor's surface, either exposed or unexposed to light, depending upon the relative electrostatic charges on the surfaces of the photoconductor, the development electrode and the toner. The photoconductor may be either positively or negatively charged, and the toner system similarly may contain negatively or positively charged particles.

A sheet of paper or intermediate transfer medium is given an electrostatic charge opposite that of the toner and then passed close to the photoconductor's surface, pulling the toner from the photoconductor's surface onto the paper or immediate medium in the pattern of the image developed from the photoconductor's surface. A set of fuser rolls or belts, under heat, melts and fixes the toner to the paper or medium surface subsequent to transfer, producing the printed image.

After the image is transferred to the paper or other recording medium, it goes to the fuser where the medium is moved through a fuser nip where it is heated and pressed. This melts the thermoplastic portion of the toner, causing it to bond to the medium, thereby fixing the image onto the surface.

The process of fixing the image involves coalescing and binding the toner image to a plastic or paper substrate or other media. A fuser system typically supplies the heat to the toner. The fuser system may employ two rollers in nip relation through which the paper sheet or transparency passes for fusing. Heat may be provided by a halogen lamp placed inside one or both of the rolls. Alternatively, the fuser may be a belt fuser employing a polymeric type belt, e.g. a polyimide belt or even a metal belt wrapped over a ceramic or other low thermal capacity heater. The belt is typically pressed against a silicon-coated backup roll to form a nip.

Figure 1:
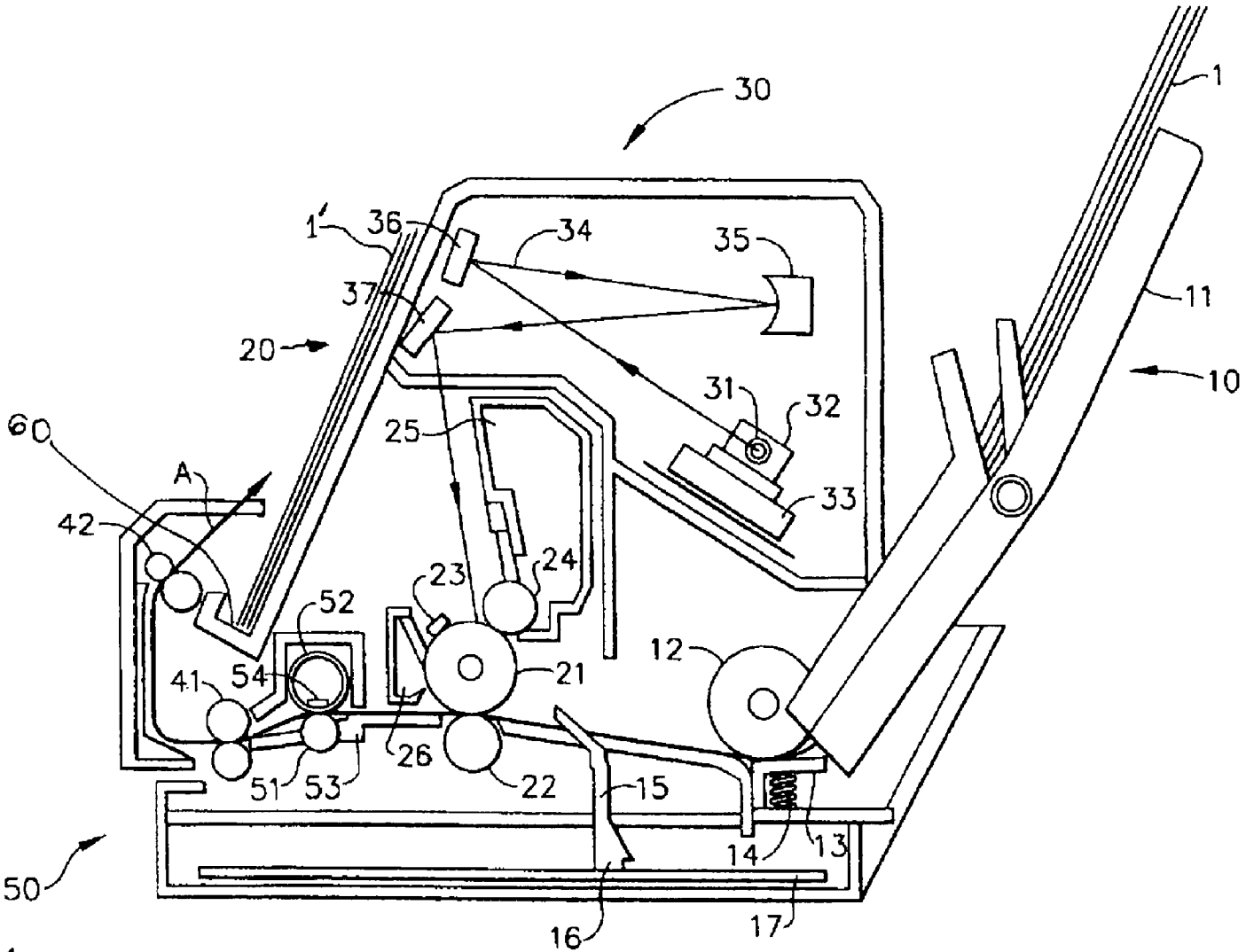
FIG. 1 is illustrative of a printer or other imaging device in connection with the present invention.

A somewhat standard design for a laser printer, a representative electrophotographic device, is shown in FIG. 1. It includes a media feed section (10), an image-forming device (20), a laser scanning section (30), and a fixing device (50). The paper feed section (10), sequentially transports sheets of recording media (or other printing media) (1) to the image-forming device (20) provided in the printer. The image-forming device (20) transfers a toner image to the transported sheet of recording media (1). The fixing device (50) fixes toner to the sheet of recording media (1) sent from the image-forming device (20). Thereafter, the sheet of recording media (1) is ejected out of the printer by paper transport rollers (41, 42) and into the output bin (60) and shown as 1'. In short, the sheet of recording media (1) moves along the path denoted by the arrow (A) in FIG. 1.

The media feed section (10) includes a feed tray (11), a feed roller (12), a paper separating friction plate (13), a pressure spring (14), a media detection actuator (15), a media detection sensor (16), and a control circuit (17).

Upon receiving a print instruction, the sheets of recording media (or in the case of the present invention, paper) (1) which have been placed in the media feed tray (11) are fed one-by-one into the printer by operation of the printer feed roller (12), the media separating friction plate (13) and the pressure spring (14). As the fed sheet of paper (1) pushes down the media detection actuator (15), the media detection sensor (16) outputs an electrical signal instructing commencement of printing of the image. The control circuit (17), started by operation of the paper detection actuator (15) transmits an image signal to a laser diode light-emitting unit (31) of the laser scanning section (30) so as to control on/off of the light-emitting diode.

The laser scanning section (30) includes the laser diode light-emitting unit (31), a scanning mirror (32), a scanning mirror motor (33), and reflecting mirrors (35, 36 and 37).

The scanning mirror (32) is rotated at a constant high speed by the scanning mirror motor (33). In other words, laser light (34) scans in a vertical direction to the paper surface of FIG. 1. The laser light (34) radiated by the laser diode light-scanning unit (31) is reflected by the reflecting mirrors (35, 36 and 37) so as to be applied to the photosensitive body (21). When the laser light (34) is applied to the photosensitive body (21), the photosensitive body (21) is selectively exposed to the laser light (34) in accordance with on/off information from this control circuit (17).

The image-forming device (20) includes the photosensitive body (21), a transfer roller (22), a charging member (23), a developing roller (24), a developing unit (25), and a cleaning unit (26). The surface charge of the photosensitive body (21), charged in advance by the charging member (23) is selectively discharged by the laser light (34). An electrostatic latent image is thus formed on the surface of the photosensitive body (21). The electrostatic latent image is visualized by the developing roller (24), and the developing unit (25). Specifically, the toner supplied from the developing unit (25) is adhered to the electrostatic latent image on the photosensitive body (21) by the developing roller (24) so as to form the toner image.

Toner used for development is stored in the developing unit (25). The toner contains coloring components (such as carbon black for black toner) and thermoplastic components. The toner, charged by being appropriately stirred in the developing unit (25), adheres to the above-mentioned electrostatic latent image by an interaction of the developing bias voltage applied to the developing roller (24) and an electric field generated by the surface potential of the photosensitive body (21), and thus conforms to the latent image, forming a visual image on the photosensitive body (21). The toner typically has a negative charge when it is applied to the latent image, forming the visual image.

Next, the sheet of paper (1) transported from the feed section (10) is transported downstream while being pinched by the photosensitive body (21) and the transfer roller (22). The paper (1) arrives at the transfer nip in timed coordination with the toned image on the photosensitive body (21). As the sheet of paper (1) is transported downstream, the toner image formed on the photosensitive body (21) is electrically attracted and transferred to the sheet of paper (1) by an interaction with the electrostatic field generated by the transfer voltage applied to the transfer roller (22). Any toner that still remains on the photosensitive body (21), not having been transferred to the sheet of paper (1), is collected by the cleaning unit (26). Thereafter, the sheet of paper (1) is transported to the fixing device (50). In the fixing device (50), an appropriate temperature and pressure are applied while the sheet of paper (1) is being pinched by moving through the nip formed by a pressure roller (51) and the fixing roller or belt (52) that is maintained at an elevated temperature. The thermoplastic components of the toner are melted by the fuser belt (52) and fixed to the sheet of paper (1) to form a stable image. The sheet of paper (1) is then transported and ejected out of the printer by the printer transport rollers (41, 42) and into the output bin (60) where it may be stacked, one sheet (referenced as 1') of printed paper upon another.

The fixing belt (52) is generally an endless belt or tube formed from a highly heat resistive and durable material having good parting properties and a thickness of not more than about 100 μm, preferably not more than about 70 μm. Preferred belts are made from a polyimide film. The belt may have an outer coating of, for example, a fluororesin or Teflon® material to optimize release properties of the fixed toner from the belt. Such fuser belts are well-known in the art. A heater (54), generally a ceramic heater, is placed on the inside surface of the belt and the outside surface of the belt forms a fusing nip (66) with the backup roller (51) at the location of the heater. Put another way, the heater (54) and the backup roller (51) with the fuser belt (52) interposed between them form the nip (66). Each sheet carrying the toner travels through this nip [i.e., between the fuser belt (52) and the backup roller (51)] and the toner is fixed on the sheet through the combination of applied heat, the time the page is in the fuser nip, and pressure. The polyimide belt is typically thin so that heat is readily transferred from heater (54). The pressure or backup roller (51) has a thermal mass that is sufficient to store thermal energy received from the heater (54). Typically, the pressure between the fuser belt (52) and the backup roller (51) at the fuser nip (66) is from about 5 psi to 30 psi. While the fuser belt (52) may be driven itself, often this is not the case. Generally, the backup roller (51) is rotated and it is the friction between the surface of the backup roller (51), and the printed sheet and ultimately the surface of the fuser belt (52), which causes the fuser belt (52) to rotate.

The backup or pressure roller (51) may be generally cylindrical in shape. It may be made from or is coated with a material that has good release and transport properties for the paper (1). The backup roller (51) may be sufficiently soft so as to allow it to be rotated against the fuser belt (52) to form a nip (66) through which the printed sheets of paper travel. By going through this nip, printed sheets are placed under pressure and the combined effects of this pressure, the time the sheet is in the nip, and the heat from the fuser belt (52) acts to fix the toner onto the media. A preferred material for use in forming the backup roller (51) is silicone rubber. The roller typically has an aluminum core with a silicone rubber layer molded or adhesively bonded onto its surface. This roller may also have a fluoropolymer (e.g., Teflon® sleeve or coating). The backup roller may be essentially hollow, having a metallic core, an outer metallic shell surrounding and essentially concentric with the core, and ribs between the core and the outer shell.

Figure 2:
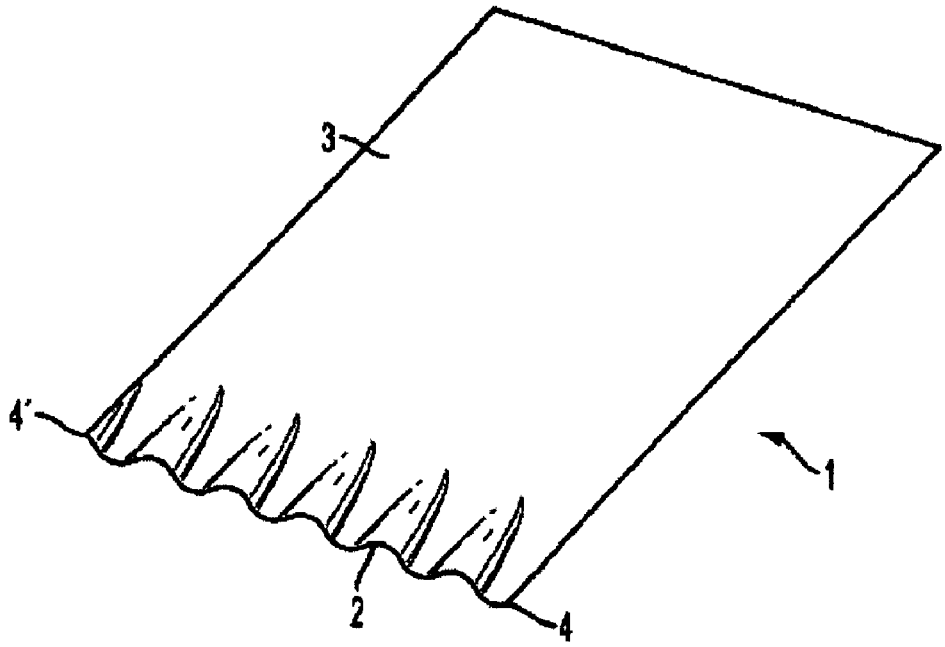
FIG. 2 is a schematic illustration of a sheet of media paper with a wavy edge as a result of local exposure to a humid environment.
Figure 3:
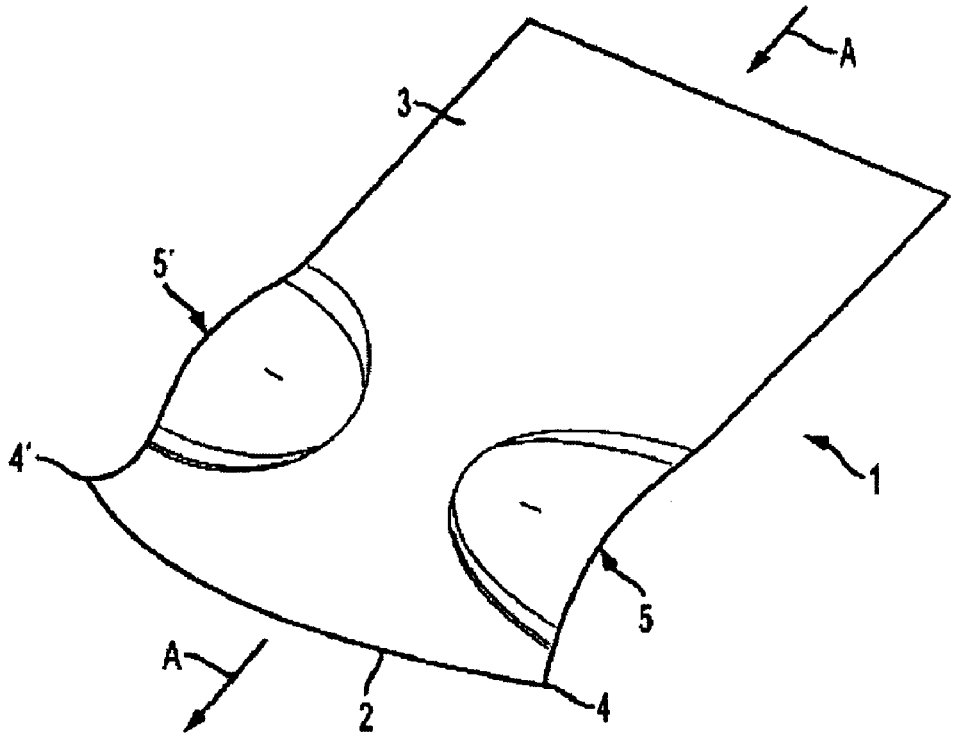
FIG. 3 is a representation of the stretching of the wavy leading edge of the sheet of paper of FIG. 2 when acted upon by a fuser nip without the benefit of the present invention.

Turning to FIGS. 2 and 3, the problems with wavy edged sheets of paper will now be described.

Specifically, in the context of the present invention, it has been recognized that some of the possible scenarios of moisture absorption from a humid environment, leading to wavy edged sheets of paper media, may be as follows:

(a) The sheets of paper may remain uniformly dry with little or no moisture absorbed if the paper is used immediately after removal from its packaging. This may occur under typical mild environmental conditions.

(b) The sheets of paper may be uniformly saturated with moisture as would occur to the top sheets of a ream removed from its protective packaging when the surrounding environment (ambient) was hot and humid (for instance about 80% Relative Humidity). The sheets from the top would have their full surface fairly uniformly penetrated by moisture.

(c) A third scenario occurs for the sheets in the middle of the ream in scenario (b) above, as only the edges would be directly exposed to the environment while the center of the sheets in the middle of the ream would remain relatively dry, as originally packaged.

(d) A fourth condition may exist when paper remains stored in its wrapper or packaging after only one end of the packaging has been opened and the sheets of paper are exposed to moisture only at open end of the ream.

It has been found that scenarios (c) and (d) produce sheets of paper media which have moisture gradients across the length and width of the sheets. When paper absorbs moisture, the paper's fibers may also swell and lengthen causing a distortion of the normally rectangular (8.5"×11" or A4 size) shape. In any event, this gradient translates to sheets having one or more wavy edges due to the swelled and lengthened paper fibers.

FIG. 2 illustrates a sheet of paper which has been exposed to a high level of ambient humidity on one end, as described in scenario (d), where the protective packaging for the ream is opened only on one end to remove a few sheets. Thus, moisture is absorbed at the one exposed end of the sheets remaining in the packaging, creating a moisture gradient from the exposed end of those sheets in comparison to the drier protected end which has remained covered by the packaging. The moisture gradient thus formed acts upon the exposed end of the remaining sheets to form a lengthened edge (2). The lengthening of edge (2) is caused by the swelling of the paper fibers, but because the sheet is constrained by the dimension of the dry portion (3) of the sheet, a boundary condition is essentially set up that will not allow the lengthened edge (2) of the sheet to be substantially wider than the dry portion (3). The edge (2) becomes wavy or buckles due to this constraint and remains essentially the same effective horizontal width as the remainder of the sheet. In other words, for an 8.5"×11" size sheet of paper, the distance between corners (4) and (4') remains about 8.5".

In the scenario described in (c), some or all of the edges of sheets lying in the center of a stack or ream which have been exposed to a high humidity environment may become wavy for the same reasons.

If the sheet (1) in FIG. 2 is fed, edge (2) first, (in the direction shown by Arrow A, FIG. 3) through a fuser nip for subsequent processing, it may resemble the sheet illustrated in FIG. 3. The edge (2) may be pressed out by the compressive forces applied by the wedging in the nip, making the edge (2) flat. The edge (2) is now fully elongated and longer (sheet is wider at the leading edge than the dry paper portion (3) behind it). A stress reaction in the sheet of paper results whereby the edge (2) curves to accommodate the difference in length (width across the sheet) but is constrained by the dry portion (3) of the paper, and the corners (4, 4') are pushed outward and rearward towards the remainder of the sheet of paper that has yet to pass through the nip. The result of the pushed back corners (4, 4') is that the sheet of paper buckles along both sides (5, 5') to absorb the increase in the width of the leading edge (2). These buckles (5, 5') may occur on both sides of the sheet of paper (1) just before the nip and set up a compressive force on the width of the paper that continues as the paper passes through the nip. The buckles (5, 5') grow in size as the sheet moves through the nip and eventually the buckles become large enough that the column strength is insufficient to support the buckles and they weaken and fold over. These folds are subsequently ironed out in the nip, resulting in wrinkles in the sheet of paper (1). The severity and frequency of wrinkles depend upon the moisture gradient across the sheet of paper (1).

To reduce the occurrence of paper edge spreading upon nip entry as shown in FIG. 3, the corners (4, 4') and outside edges of the sheet of paper (1) may be preferably constrained before entering the nip. This is accomplished by, in a preferred embodiment, molding features into the ends of the plastic heater housing (62) to constrain the corners of the paper sheet (1) from moving laterally. Alternatively, the features may be manufactured separately and attached. This heater housing (62) in FIG. 4 may be a plastic molding which includes the ceramic heater which, for an instant-on heater, is typically flat. A hot roller heater generally has a curved surface that contracts the paper and may provide some column strength to the paper sheet by curling the paper slightly as the paper travels through the nip and the fusing process. An instant-on heater, since it is flat, does not provide any column strength to the sheet of paper so alternate means must be used to prevent paper wrinkling.

Figure 4:
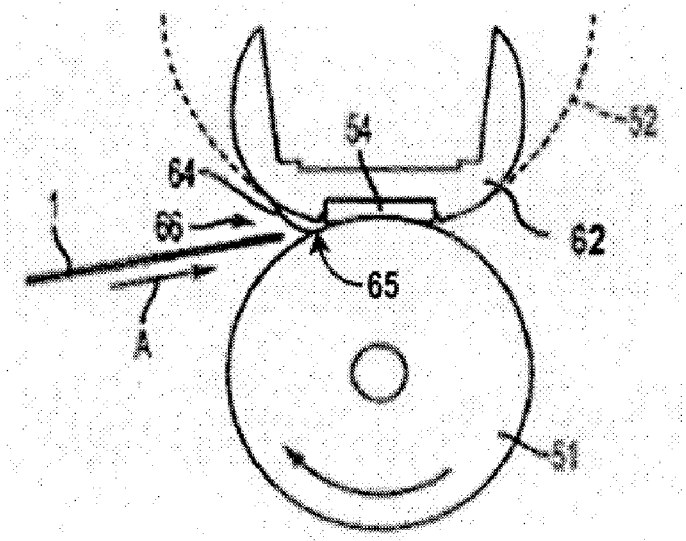
FIG. 4 is an end view of the molded features of the present invention.

FIG. 4 is a sectional view of the backup or pressure roller (51) and heater housing (62) cooperating to form a nip (66) in the fuser to draw the paper (1) through and fix the toner onto the paper. The paper (1) is traveling in the direction of arrow A into the nip (66). The fuser belt (52) shown in FIG. 1 is shown as a dotted line in FIG. 4 to aid in clarity of the invention. It also passes through the fuser nip and typically is driven by the pressure roller (51). To constrain the corners (4, 4') of the paper from spreading apart as the sheet enters the nip (66), a protruding feature (64, 64') may be incorporated or integrally molded into the heater housing (62) at each end of the housing. These features (64, 64') (see FIG. 5) may be preferably spaced apart by the approximate width of the paper, usually 8.5"×11" or A4 width (210 mm) and protrude from the nip towards the incoming sheet of paper such that the corners of the paper (4, 4') are pinched and constrained between the roll (51) and the features (64, 64') before the paper (1) enters the nip (66). Preferably, these features are about 1" wide per side and extend outward from the nip (66) in a preferably curved fashion to form an interference at each longitudinal side of the paper (1) towards the incoming sheet.

These features (64, 64') may preferably create a relatively low pressure contact area (65) with the pressure roller (51) in front of the fuser nip (66) and grip the leading corners (4, 4') and the outside edges of the paper before the paper makes contact with the fuser belt (52) or enters the nip. Thus the wavy edge (2) of the paper (see FIG. 2) is, preferably, not allowed to substantially flatten and spread or transfer stress to the immediate trailing portions of the sheet, which would lead to buckles (waves transferred down the longitudinal sides of the paper), leading to wrinkle formation when passing through the nip.

For the present invention, the shape of the features (64, 64') may be any shape that provide a constraint on, preferably, the leading corners (4, 4') and longitudinal edges of the sheet of paper (1) to prevent spreading of the corners (4, 4'). The interference may preferably be adjusted so as not to cause excessive wear on either the surface of the belt or roller.

Figure 5:
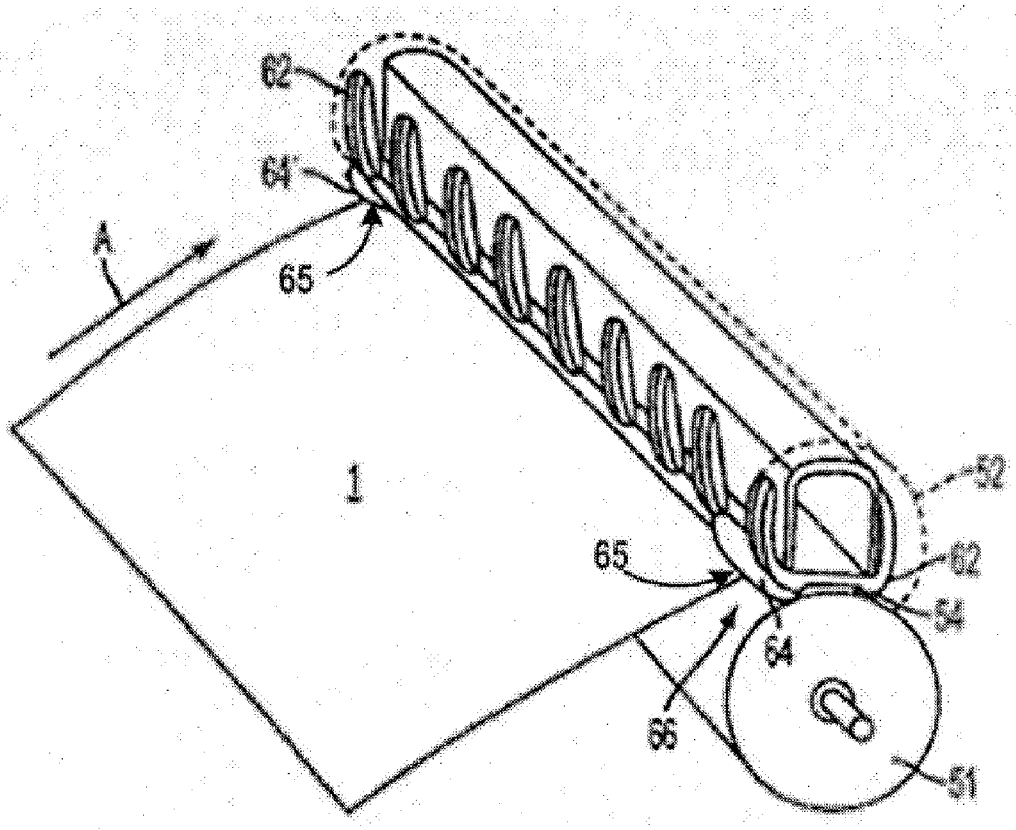
FIG. 5 is an isometric view of a fuser nip showing one embodiment of the molded features of the present invention.

FIG. 5 is an isometric view of the fuser nip (66) of the present invention and shows the molded features (64, 64') as part of the heater housing (62), spaced apart by the approximate width of the paper. As in FIG. 4 the belt (52) is shown as a dotted line to aid in understanding the invention.

A pressure roller (51) engages the heater housing (62) with the belt (52) interposed between to form a nip (66). The heater (54) is housed in the housing (62) and provides heat through the belt to fix the toner on the sheet of media. At each end of the heater housing (62) features are provided (64, 64'), spaced apart by the approximate width of the sheet of media (1), which protrude outward from the nip (66) towards the incoming sheet of media (1) to constrain the leading corners (4, 4') of the sheet (see FIGS. 2 and 3). These features (64, 64') substantially reduce the transmission of a wavy leading edge to the longitudinal sides of the sheet of media (1), thus substantially reducing the occurrence of wrinkling as the sheet travels through the nip.

Although a preferred embodiment has been illustrated and described, various alternatives, modifications and equivalents may be used. Therefore, the foregoing description should not be taken as limiting the scope of the invention, which is described by the appended claims. The illustrations shown in the present application are intended to be illustrative of the present invention and not limiting thereof. The full scope of the present invention is defined by the following claims and equivalents thereof.

What is claimed is:

1. An apparatus for fixing an image on a sheet of recording media, the sheet of media having a width including leading corners and outside edges relative to its path through said apparatus, comprising:

a heater mounted in a heater housing, the housing having laterally spaced apart ends;

a belt slideable on said heater;

a driven roller, said heater cooperating with said driven roller, with said belt being interposed between said driven roller and said heater to form a relatively high pressure nip;

wherein said heater housing includes protruding features each located at an end and spaced apart by the width of the media, said protruding features available to engage and laterally constrain the leading corners and outside edges of said sheet of supplied media before said media enters said nip in a feed direction to reduce the occurrence of media edge spreading upon nip entry and wherein said features at each end of the heater housing extend toward said feed direction form an interference and a relatively low pressure contact area between said driven roller and said leading corners and outside edges of said media in front of said nip.

2. The apparatus of claim 1 wherein said sheet of recording media comprises paper.

3. The apparatus of claim 1 wherein said heater is an instant-on heater.

4. The apparatus of claim 1 wherein said protruding features are integrally formed as part of said heater housing.

5. The apparatus of claim 1 wherein said protruding features are attached to said heater housing.

6. The apparatus of claim 1 wherein said protruding features extend from the nip toward said supplied sheet of media to constrain said sheet as the sheet enters the nip.

7. The apparatus of claim 1 wherein said sheet of media has a width and a leading edge, and said protruding features operate to constrain said width of the leading edge of the sheet of paper as said media enters said nip.

8. A method for reducing wrinkling of a sheet of print media in an electrophotographic device, the sheet of print media having a width including leading corners and outside edges relative to its path through said apparatus, comprising the steps of:

providing a heater mounted in a heater housing, the housing having laterally spaced apart ends;

providing a belt slideable on said heater;

providing a driven roller, said heater cooperating with said driven roller, with said belt being interposed between said driven roller and said heater to form a relatively high pressure nip;

wherein said sheet of media is transported through said nip in a feed direction by said roller and an image carried on said sheet of media is heated through said belt while in the nip by heat from said heater; wherein said heater housing includes features each located at an end and protruding towards said feed direction and spaced apart by the width of the media, said features available to engage and laterally constrain the leading corners and outside edges of said sheet of supplied media before said media enters said nip to reduce the occurrence of media edge spreading upon nip entry wherein said sheet of media has a leading edge with leading corners and longitudinal sides, wherein said features constrain said leading corners and said longitudinal sides of said recording media before said media enters said nip and form an interference and a relatively low pressure contact area between said driven roller and said leading corners and outside edges of said media in front of said nip.

9. The method of claim 8 wherein said sheet of recording media comprises paper.

10. The method of claim 8 wherein said heater is an instant-on heater.

11. The method of claim 8 wherein said sheet of media includes a leading edge with corners and sides and said leading edge of said sheet of media is wavy and constraining the corners and sides of said sheet by said features substantially prevents wrinkles from forming in said sheet as it travels through said nip.

12. An apparatus for reducing wrinkling of a sheet of media in a fuser in an electrophotographic device, said sheet having a width including a leading edge with leading corners and longitudinal sides, the apparatus comprising:

a heater mounted in a heater housing, the housing having laterally spaced apart ends, wherein said heater housing includes protruding features each located at an end;

a belt slideable on said heater;

a driven roller, said heater cooperating with said driven roller;

said belt being interposed between said driven roller and said heater to form a relatively high pressure nip wherein said sheet of media is transported through said nip by said roller in a feed direction; and said laterally spaced apart features protruding toward said feed direction; a portion of said features spaced apart by a distance that is less than the width of said sheet of media, said features available to engage and laterally constrain the leading corners and longitudinal sides of said sheet of media before said media enters said nip to reduce the occurrence of media edge spreading upon nip entry and form an interference and a relatively low pressure contact area between said driven roller and said leading corners and longitudinal sides of said media in front of said nip.

13. An apparatus for fixing an image on a sheet of recording media, the sheet of media having a width including leading corners and outside edges relative to its path through said apparatus, comprising:

a first fuser roller including a heater, said heater mounted in a heater housing, the housing having laterally spaced apart ends, wherein said heater housing includes protruding features located at each end spaced apart by the width of said media;

a second roller, said fuser roller cooperating with said second roller to form a relatively high pressure nip, wherein an image carried on said sheet of recording media is heated by said fuser roller while in the nip by heat from fuser roller;

wherein said heater housing protruding features contact said second roller and protrude toward a media feed direction, said features available to engage and laterally constrain the leading corners and outside edges of said sheet of supplied media before said media enters said nip in said feed direction to reduce the occurrence of paper edge spreading upon nip entry and form an interference and a relatively low pressure contact area between said driven roller and said leading corners and outside edges of said sheet of supplied media in front of said nip.

14. The apparatus of claim 13 where said heater housing includes end sections and said features are present on said end sections.

15. An apparatus for fixing an image on a sheet of recording media, said media having a width, comprising:

a heater mounted in a heater housing, the housing having laterally spaced apart ends;

a belt slideable on said heater;

a driven roller, said heater cooperating with said driven roller, with said belt being interposed between said driven roller and said heater to form a relatively high pressure nip;

wherein said heater housing includes protruding features each located at an end and spaced apart by the width of said media and contacting said driven roller, said features available to engage and laterally constrain a sheet of supplied media before said media enters said nip in a feed direction wherein said sheet of media has a width and a leading edge including leading corners, and said features protrude toward said feed direction and operate to constrain said width of the leading edge of the sheet of paper to reduce the occurrence of media edge spreading when said media enters said nip and form an interference and a relatively low pressure contact area between said driven roller and said leading corners of said sheet of media in front of said nip.

16. The apparatus of claim 15 wherein said sheet of recording media comprises paper.

17. The apparatus of claim 15 wherein said heater is an instant-on heater.

18. The apparatus of claim 15 wherein said features are integrally formed as part of said heater housing.

19. The apparatus of claim 15 wherein said features are attached to said heater housing.

20. The apparatus of claim 15 wherein said features extend from the nip toward said supplied sheet of media to constrain said sheet as the sheet enters the nip.

21. A method for reducing wrinkling of a sheet of print media having a width in an electrophotographic device having a heater mounted in a heater housing having laterally spaced apart ends including a belt slidable on said heater, and a driven roller where said belt is interposed between said roller and said heater to form a relatively high pressure nip, comprising the steps of;

transporting media through said nip by said roller in a feed direction wherein said heater housing includes protruding features each located at an end and spaced apart by the width of said media and contacting said roller and protruding toward said feed direction;

wherein said sheet of media includes a leading edge with corners and sides and said leading edge of said sheet of media is wavy; and engaging and laterally constraining the corners and sides of said sheet by said features before said sheet travels through said nip and forming an interference and a relatively low pressure contact area between said driven roller and said leading corners of said sheet of media in front of said nip and reducing the occurrence of media edge spreading upon nip entry.

22. The method of claim 21 wherein said sheet of recording media comprises paper.

23. The method of claim 21 wherein said heater is an instant-on heater.

* * * * *